US007921573B1

(12) United States Patent
Mancini et al.

(10) Patent No.: US 7,921,573 B1
(45) Date of Patent: Apr. 12, 2011

(54) MONITORING VERTICALITY OF A SINKING CAISSON

(75) Inventors: Steven M. Mancini, Clinton Township, MI (US); Jerome M. Penxa, Romeo, MI (US)

(73) Assignee: Ric-Man Construction, Inc., Sterling Heights, MI (US)

( * ) Notice: Subject to any disclaimer, the term of this patent is extended or adjusted under 35 U.S.C. 154(b) by 0 days.

(21) Appl. No.: 12/729,838

(22) Filed: Mar. 23, 2010

Related U.S. Application Data

(60) Provisional application No. 61/162,637, filed on Mar. 23, 2009.

(51) Int. Cl.
*G01C 9/10* (2006.01)
*E21B 47/02* (2006.01)

(52) U.S. Cl. ..... 33/365; 33/302

(58) Field of Classification Search ..... 33/365, 33/300, 302, 304, 305, 306, 307, 313, 339, 33/1 H See application file for complete search history.

(56) References Cited

U.S. PATENT DOCUMENTS 3,779,322 A * 12/1973 Stevens ..... 405/133
4,214,374 A * 7/1980 Miotti ..... 33/300
4,797,031 A 1/1989 Hagimoto et al.
4,867,609 A * 9/1989 Grosman ..... 405/195.1

OTHER PUBLICATIONS

Sinking Caisson Serves as Excavation and Permanent Support Structure, Publication No. C880107, Copyright 1988, The Aberdeen Group, 3 pages.
G2 Gets that Sinking Feeling, Groundbreaking Solutions, Issue 3, 2005, 1 page.
Walbridge Aldinger and MIOSHA Launch Historic Construction Partnership to Protect Workers; Jan. 12, 2005, 4 pages.

* cited by examiner

*Primary Examiner* — Yaritza Guadalupe-McCall
(74) *Attorney, Agent, or Firm* — Reising Ethington P.C.

(57) ABSTRACT

A method of monitoring verticality of a sinking caisson having a tip. A pole is inserted into the earth to a pole depth substantially corresponding to a desired final depth of the caisson tip, one or more levels are coupled to the pole, and an elevation of the levels(s) is established. Scales are carried on an interior surface of the caisson in spaced circumferential locations and in reference to the caisson tip, and the level(s) is applied to the scales to indicate heights from the caisson tip corresponding to the circumferential locations of the scales. Tip elevations corresponding to the circumferential locations of the scales are determined by subtracting the indicated heights from the established elevation of the level(s). Any tilt of the caisson is calculated from any differences among the determined tip elevations.

12 Claims, 9 Drawing Sheets

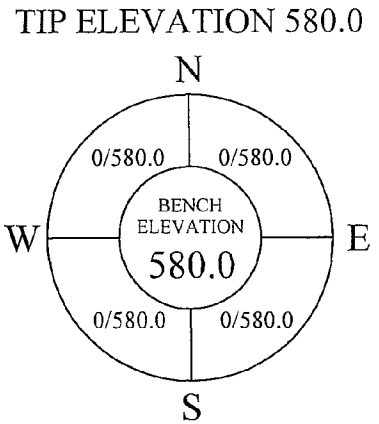
FIG. 18A
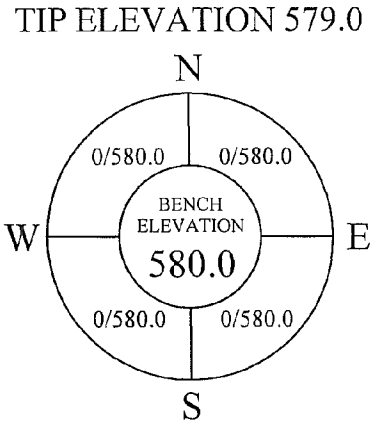
FIG. 18B
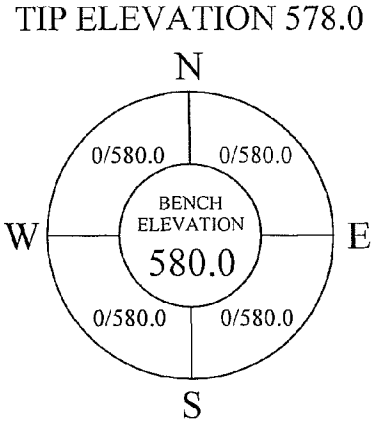
FIG. 18C
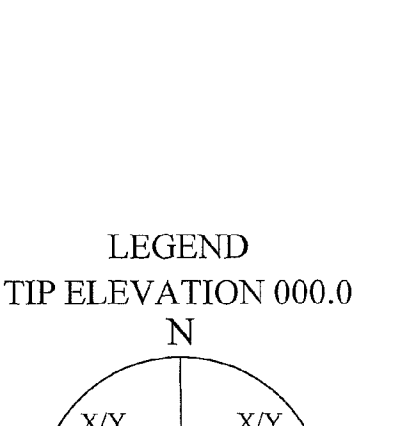
FIG. 18G
FIG. 18D
FIG. 18E
FIG. 18F

MONITORING VERTICALITY OF A SINKING CAISSON

CROSS-REFERENCE TO RELATED APPLICATION

This application claims the benefit of U.S. Provisional Application No. 61/162,637, filed Mar. 23, 2009, the disclosure of which is incorporated herein by reference.

TECHNICAL FIELD

The present disclosure relates generally to construction methods and, more particularly, to monitoring installation of a sinking caisson.

BACKGROUND

Caissons are structures embedded into the earth that may serve as reservoirs, mine shafts, pits, piles, or the like. Sinking caissons are also their own best excavation tool because their massive weight is used to embed or sink them into the earth. A non-limiting example of a typical sinking caisson is set forth below.

A typical sinking caisson is generally hollow, may be open or closed, and may be circular or of any other suitable shape. The caisson is preferably a multiple stage hollow cylinder, or annulus, composed of steel bar reinforced concrete and usually about 30 to 150 feet in diameter and with a side wall about 5 to 10 feet thick. The caisson includes a first stage comprised of a concrete, partially wedge-shaped in cross section cutting shoe. The shoe is tapered from a shelf at an outside surface to a cutting tip which is only about 1 to 2 feet thick to pierce the earth.

The cutting shoe is cast in-situ on a circular launch pad typically of timbers lying on a circular bed of crushed rock, and one or more additional stages of concrete rings may be cast in-situ on the cutting shoe before sinking begins. Each stage of a concrete ring may weigh hundreds of thousands or even millions of pounds depending on the diameter and wall thickness of the caisson and the soil conditions into which it will sink. Sinking of the caisson is launched by removing the timbers so that the caisson begins to sink into the earth under its own weight. The caisson continues to sink, increasing its embedded length, until a sinking force of the caisson is equalized by earthen drag forces imposed on the interior and exterior surfaces of the caisson including the shoe.

An excavator is disposed within the periphery of the caisson on an earthen bench. The excavator removes earth from a trench adjacent the caisson interior surface to reduce the drag force acting on the interior of the caisson at the shoe. The excavator also removes earth from the bench to reduce the exterior drag force by allowing controlled floor heave from outside to inside earthen flow around and under the tip of the shoe. Lubricant materials may be pumped to the outside perimeter of the caisson to further reduce the exterior drag force.

Successive rings of concrete are poured or cast (with suitable forms) on top of one another to increase the caisson length so the caisson sinks into the earth. This also increases the caisson weight and sinking force, causing the caisson to sink further into the earth. The excavation and construction is continued so that the caisson tip reaches a desired final depth typically resting on bed rock.

But the sinking caisson may tilt as it sinks into the earth because of imperfections in excavation as well as the heterogeneous or varying structure of the earth. Current attempts to control such tilt include use of time-consuming traditional surveying manpower, equipment, and methods, including multi-person crews, transits, and referencing of surface earth benchmarks located outside of and distal from the caisson and the continuously moving top of the caisson. But such methods are prone to many errors inherent in the surveying equipment and in multi-person surveying techniques. Therefore, such methods are unsatisfactory because they are unable to rapidly and accurately assess caisson tilt. Thus, caisson sinking is inadequately controlled, thereby resulting in cracked or otherwise structurally compromised caissons.

SUMMARY

A method according to one implementation includes monitoring verticality of a sinking caisson having a tip. The method comprises placing a pole into the earth to a pole depth corresponding substantially to a desired final depth of the caisson tip, coupling at least one level to the pole, and establishing an elevation of the at least one level. The method also comprises carrying scales on an interior surface of the caisson in spaced circumferential locations and in reference to the caisson tip, and applying the at least one level to the scales to indicate heights from the caisson tip corresponding to the circumferential locations of the scales. The method further comprises determining tip elevations corresponding to the circumferential locations of the scales by subtracting the indicated heights from the established elevation of the at least one level, and calculating any tilt of the caisson from any differences among the determined tip elevations.

According to other embodiments, the circumferential location of the high point of any tilt may also be calculated. The extent of any tilt from vertical and its high point or circumferential location may be utilized to adjust control evacuation and pouring of a concrete ring stage to realign the sinking caisson to decrease its tilt from its designed or desired verticality.

BRIEF DESCRIPTION OF THE DRAWINGS

These and other objects, features and advantages of the present invention will be apparent from the following detailed description of preferred embodiments and best mode, appended claims, and accompanying drawings in which:

FIGS. 18A-18F are schematic views of an example excavation plan for the sinking caisson of FIG. 1; and FIG. 18G is a schematic view of an example legend corresponding to the example excavation plan illustrated in FIGS. 18A-18F.

DETAILED DESCRIPTION

In general, an illustrative sinking caisson installation will be described using one or more exemplary embodiments of a method of monitoring tilt of a sinking caisson. However, it will be appreciated as the description proceeds that the method is useful in many different applications and may be implemented in many other embodiments. Quality assurance and control requirements demand that tilt of a sinking caisson is correctly monitored. The claimed method ensures improved monitoring over prior techniques.

Figure 1:
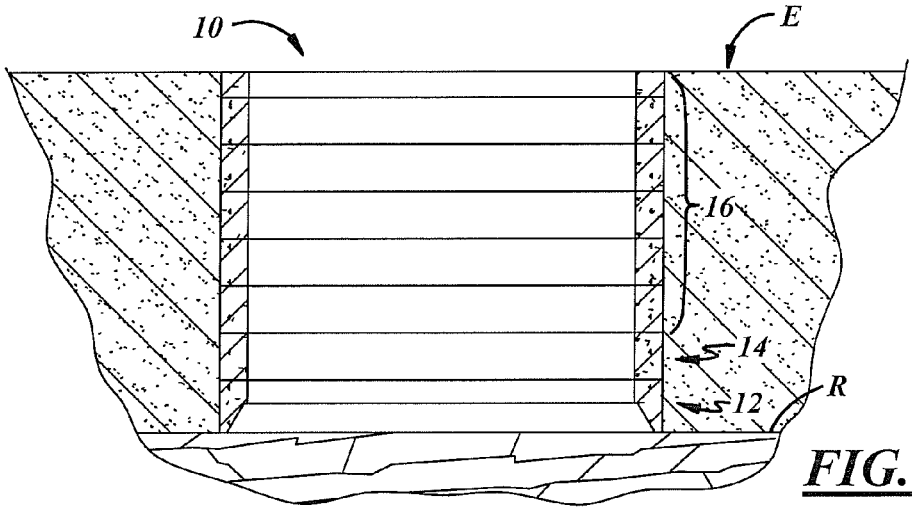
FIG. 1 is an elevational, cross-sectional view of an illustrative form of a sinking caisson embedded in the earth.

Referring in more detail to the drawings, FIG. 1 illustrates an illustrative sinking caisson 10 embedded in a portion of the earth E. The caisson 10 includes multiple stages including a cutting shoe 12 used to pierce the earth E during installation, one or more launch stages 14 disposed atop the cutting shoe 12, and multiple driving stages 16 disposed atop the launch stage(s) 14. The caisson 10 has been installed to a desired final depth, for example, to a layer of bedrock R in the earth E. In the illustrated example, the desired final depth may be about 100 feet.

Figure 2:
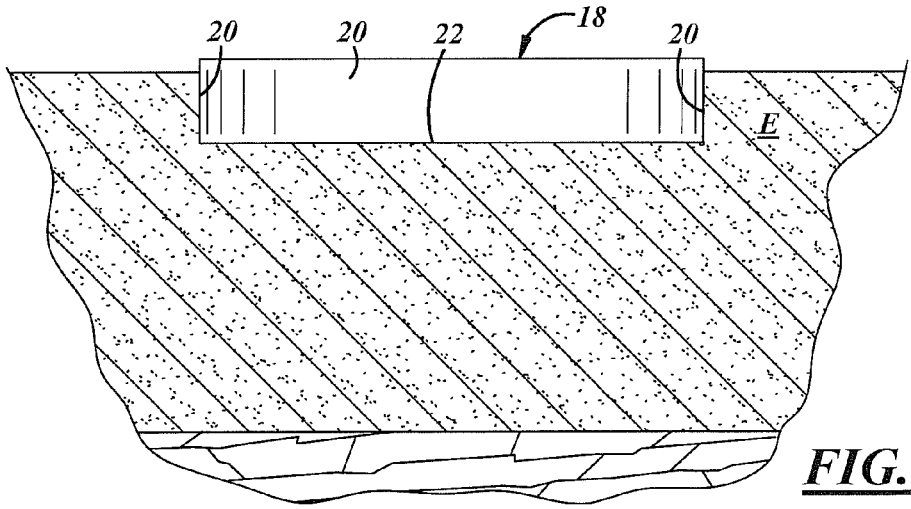
FIG. 2 is an elevational, cross-sectional view of an illustrative form of a sinking caisson starter pit.

Referring now to FIG. 2, to install the caisson of FIG. 1, a starter pit 18 may be constructed by driving a perimeter of sheet piles 20 into the earth E to a desired pile depth, and excavating earth from within the perimeter to a desired starter pit depth. For example, the pit depth may be about 15 feet. A bottom 22 of the pit 18 may be compacted and leveled to provide a good level work surface.

Figure 3:
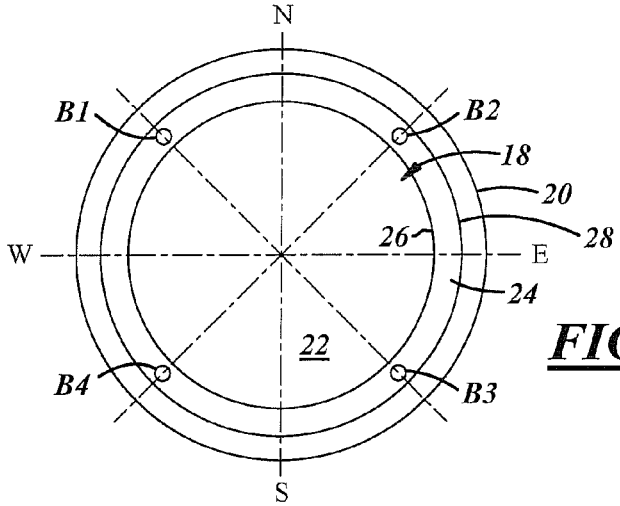
FIG. 3 is a schematic plan view of the starter pit of FIG. 2, illustrating soil profile bores.
Figure 4E:
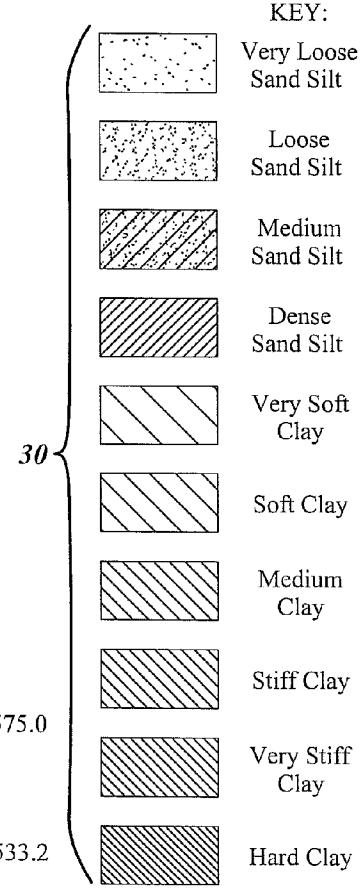
FIG. 4E is a legend of soil types corresponding to the soil profile of FIG. 4A.
Figure 4B:
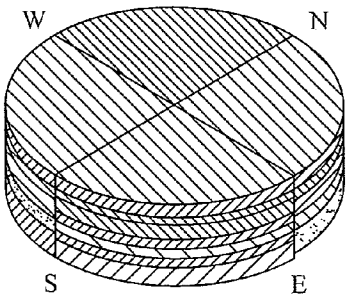
FIG. 4B is a perspective view of the soil profile of FIG. 4A.
Figure 4A:
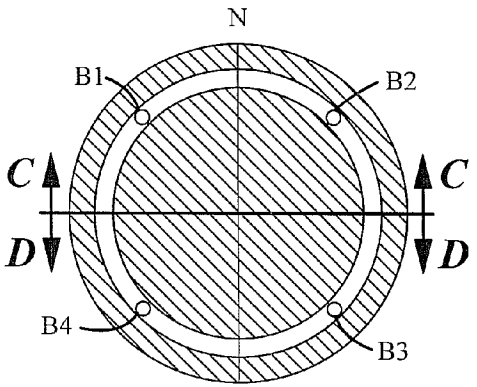
FIG. 4A is a schematic plan view of an example soil profile.
Figure 4D:
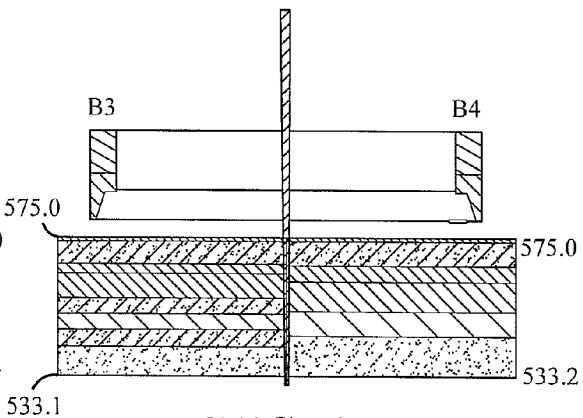
FIG. 4D is a schematic cross-sectional view taken from line D-D of the soil profile of FIG. 4A.
Figure 4C:
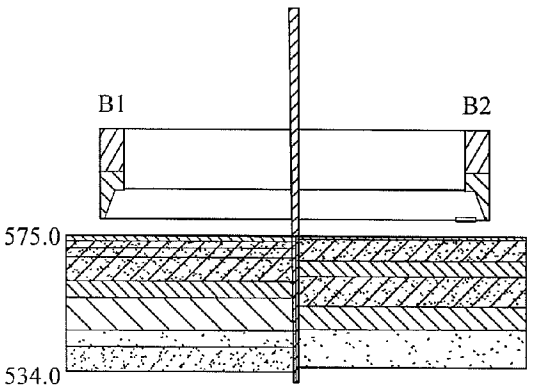
FIG. 4C is a schematic cross-sectional view taken from line C-C of the soil profile of FIG. 4A.

As shown in FIG. 3, a caisson perimeter 24 may be established in the starter pit 18. For example, the perimeter 24 may correspond to caisson inner and outer diameters 26, 28. Also, preferably several soil bores B1, B2, B3, B4 may be drilled around the caisson perimeter 24 to a depth corresponding substantially to a desired final depth of the caisson tip. The soil bores may be equally circumferentially spaced apart around the caisson perimeter. The bores B1, B2, B3, B4 may be drilled, as shown, in four quadrants: Northwest, Northeast, Southeast, Southwest.

Referring now to FIGS. 4A-4E, a soil profile or layer-by-layer assessment of earth type may be conducted from the soil bores B1, B2, B3, B4. The soil profile may include varying soil types 30 from very loose sand silt to very soft clay to hard clay and everything in between. As shown in the example, in the first layer, one of four quadrants (Northwest) includes soil different in composition than the other three quadrants. The soil profile is helpful in predicting a rate of sinkage of the caisson and, thus, determining relative amounts of excavation for each quadrant. For example, because in the first layer the Northwest quadrant has medium clay, it may be desirable to excavate somewhat less in the Northwest quadrant than in the other quadrants, which have stiff clay at that level.

Figure 5:
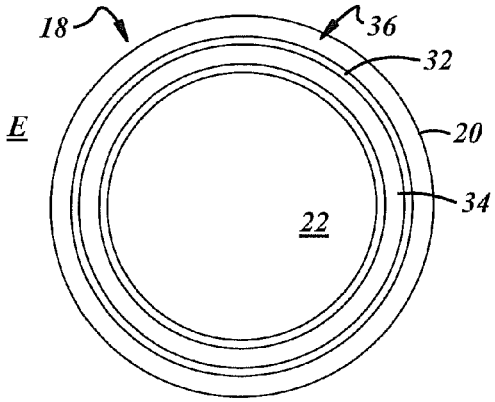
FIG. 5 is a schematic plan view of the starter pit of FIG. 2, illustrating a sinking caisson launch pad.

As shown in FIG. 5, a ring of crushed rock or stone 32 may be added over the area to be engaged by the caisson shoe (hidden) to any suitable height, for example, about 5 feet. Then, a perimeter of timbers 34 may be laid on top of the stone 32 and leveled to define a launch pad 36.

Figure 7:
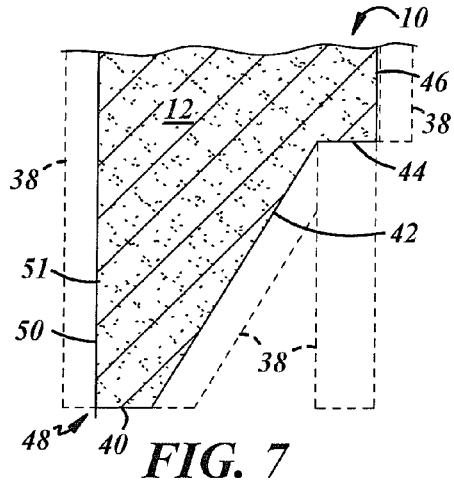
FIG. 7 is a fragmentary cross-sectional view of a portion of the sinking caisson of FIG. 6.
Figure 6:
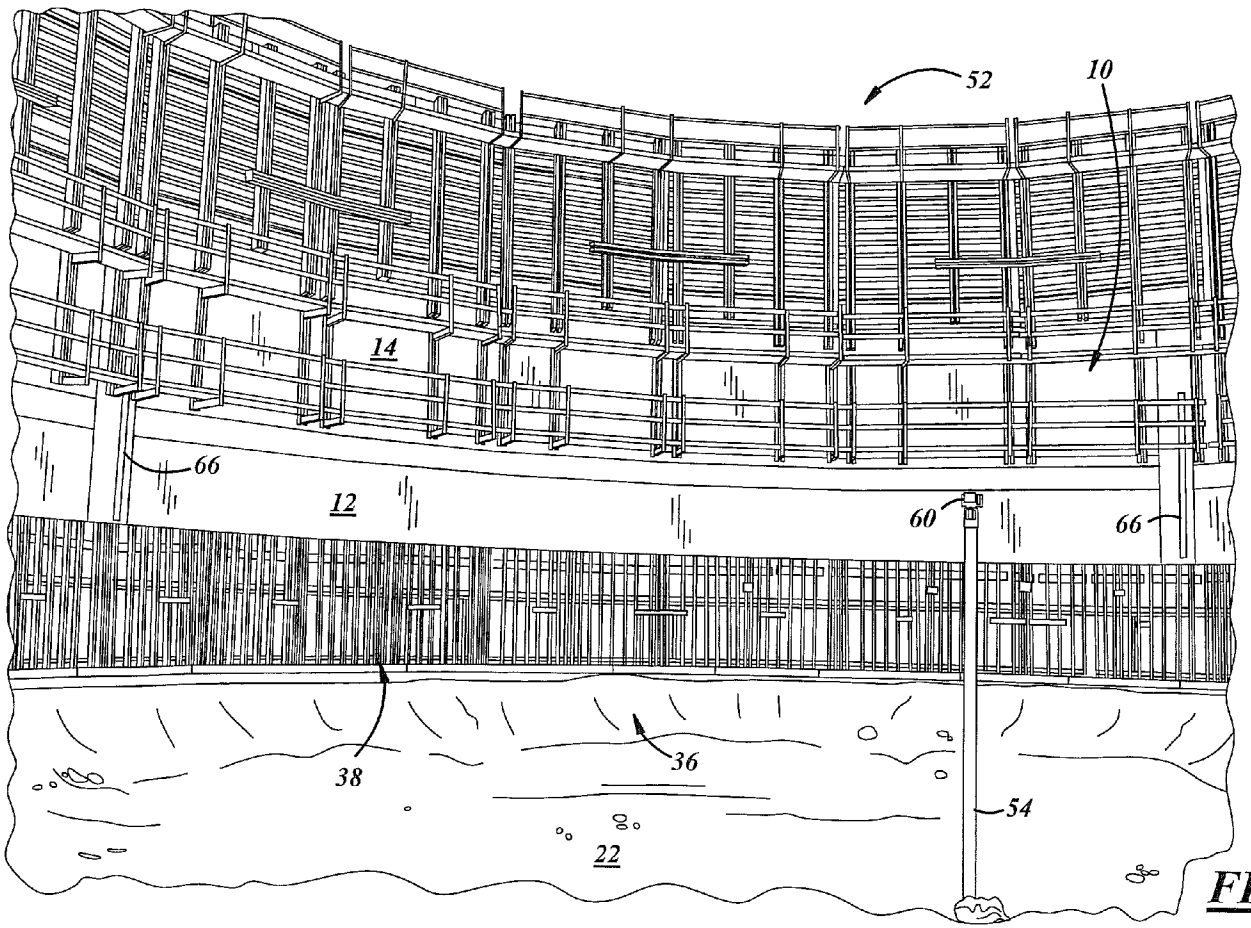
FIG. 6 is a perspective view from the inside of an example sinking caisson and its forms.

As shown in FIG. 6, a form 38 for pouring a concrete caisson shoe is constructed around the perimeter and over the launch pad 36. Referring now to FIG. 7, the form 38 may be shaped to form a shoe with a tip 40, a tapered portion 42 extending radially inwardly and axially upwardly, and a shoulder or shelf 44 adjacent an inner surface 46 of the shoe 12. The tapered portion 42 may be tapered inwardly to produce an inward flow of soil or earthen material during sinking of the caisson 10. The tip 40 also may include a sacrificial annular steel knife 48 adjacent an exterior surface 50 of the shoe 12. The exterior surface may also have a recess 51 to receive lubricants. Concrete is poured and cured or cast in the shoe form 38 in situ over the caisson perimeter and the timbers to produce the shoe 12.

Referring again to FIG. 6, a ring form 52 for subsequent caisson stages or rings is constructed around the perimeter of the formed-in-place caisson shoe 12. As shown, the launch stage(s) 14 or rings have already been poured and cast and the ring form 52 raised over the launch stage(s) 14. The various stages may be of any suitable size, for example, about 12 to 14 feet in height. As also shown in FIG. 6, a pole 54 is disposed into the earth to a pole depth corresponding substantially to the desired final depth of the caisson 10.

Figure 8:
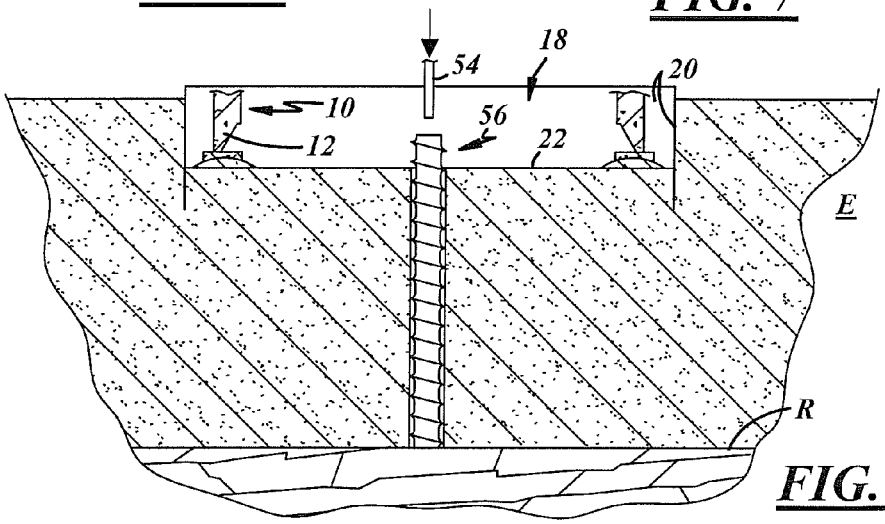
FIG. 8 is an elevational, cross-sectional view of the starter pit of FIG. 2, and illustrating an example hole being bored by an example augur and an example pole being inserted into the augur.
Figure 9:
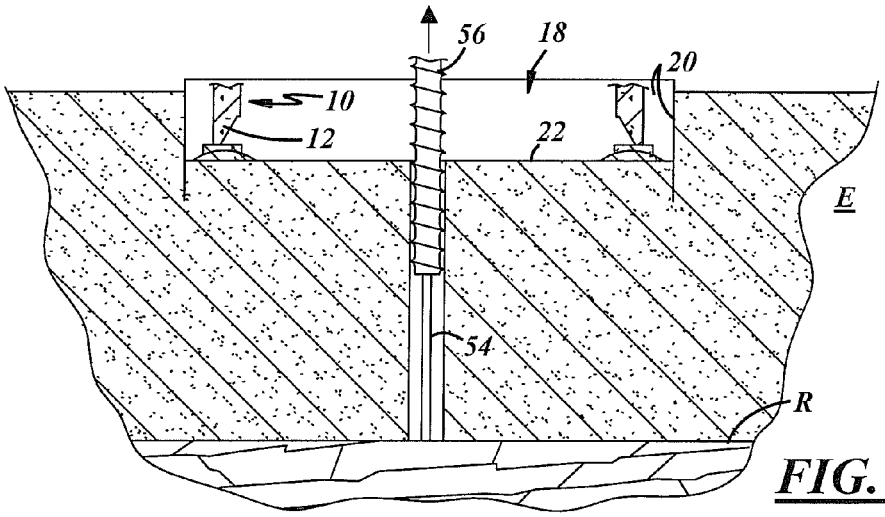
FIG. 9 is an elevational, cross-sectional view of the pole shown in FIG. 8 being referenced against bedrock and the augur being removed.

For example, referring to FIG. 8, a hollow augur 56 may be used to drill a hole into the earth E to the pole depth. For example, the augur 56 may be drilled to a depth corresponding substantially to a desired final depth of the caisson tip of the caisson 10, or at least within a predetermined height from the caisson tip desired final depth, for example, within about 10 feet. Then, the pole 54 is inserted into the hollow augur 56 to the desired final depth. As shown in FIG. 9, the hollow augur 56 is removed, and the pole 54 may be grouted in any suitable manner.

Figure 10:
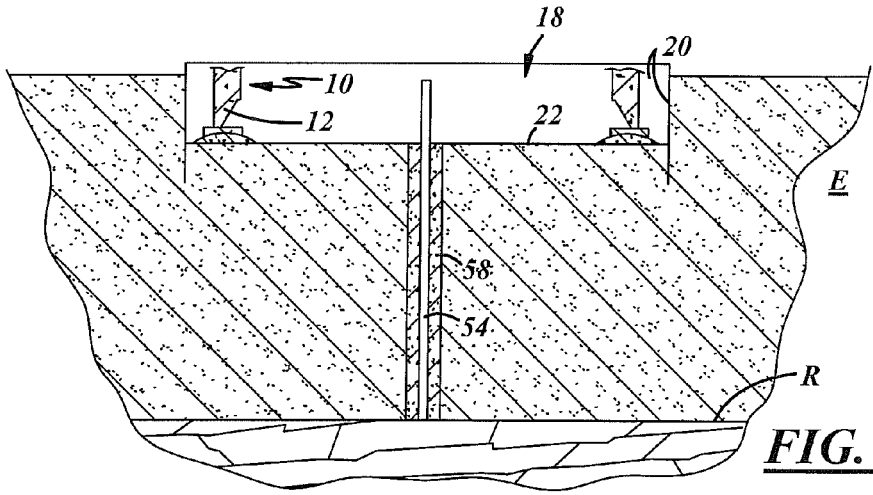
FIG. 10 is an elevational, cross-sectional view of the pole shown in FIG. 9 reinforced with grout.

For instance, as shown in FIG. 10, concrete 58 may be cast in place around the pole 54, and within the pole 54 if desired, to provide a stable, fixed reference. The pole 54 may be of any suitable type and transverse cross-sectional shape, for example, hollow or solid, box shaped or cylindrical, and may be of any suitable size, for example, about 4 to 6 inches in diameter. In the illustrated example, the pole 54 may be about 100 feet long, a hollow steel tube, and about 5 inches in diameter. Concrete or mortar may be first poured into the hole around the outside of the tube and then concrete or mortar may be poured into the hole inside the steel tube.

Figure 11:
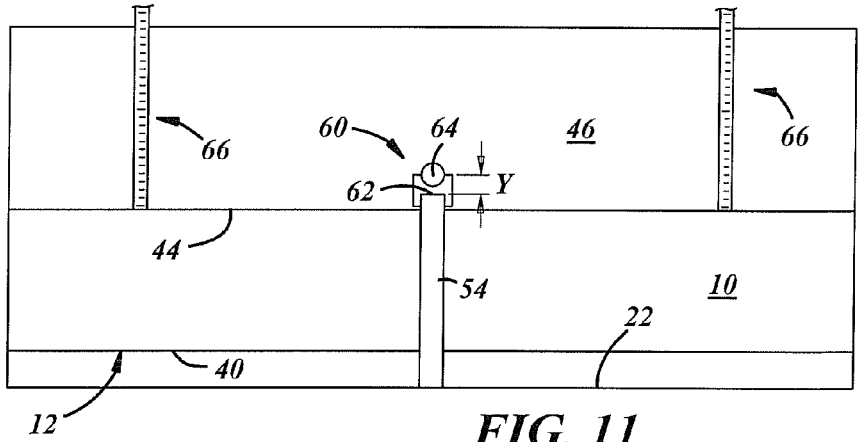
FIG. 11 is an enlarged elevational view from within the starter pit and illustrating the pole shown in FIG. 10 with a level coupled to the pole and scales carried by an inside surface of the caisson.

Referring now to FIG. 11, with the pole 54 now fixed in place, a level 60 is coupled to the pole 54. For instance, the level 60 may be coupled to a free end 62 of the pole 54, or to any other desired location on the pole 54 and in any suitable manner. The level 60 may be a RUGBY 100 brand level that includes a rotary, self-leveling laser and is available from Leica of Germany, or a SPRINTER brand digital level also available from Leica. These levels are believed to contain gyroscopes to provide and maintain a stable vertical reference to provide a rotating beam in a horizontal lever plane. For levels that are not rotary or self-rotating, any suitable rotating device may be coupled between the pole 54 and the level 60 to impart rotation to the level 60 to facilitate automatic data collection.

The elevation of the level 60 may be established in any suitable manner. For example, the elevation of the level 60 may be established in reference to a surface benchmark or a fundamental benchmark like sea level. Any suitable technique to establish the elevation of the level 60 may be used. For example, a transit and well known surveying techniques may be used to establish the elevation of the top 62 of the pole 54. In another example, because the top 62 of the pole 54 may be sufficiently exposed to the sky, a suitable global positioning satellite receiver may be placed atop the pole and used to establish the elevation of the top 62 of the pole 54. A height Y from the top 62 of the pole 54 to an optical beam 64 of the level 60 may be determined to establish the elevation of the level 60. The pole 54 may be marked in any suitable preferably equal increments from the free end 62 of the pole 54. For example, the pole 54 may be marked in increments of 5 feet.

As also shown in FIG. 11, scales 66 may be carried on the interior surface 46 of the caisson 10 at multiple circumferentially spaced locations to indicate heights from the caisson tip 40 corresponding to the scale locations. The scales 66 may be attached to the interior surface 46 of the caisson 10 above the shelf 44 of the cutting shoe 12. As just one example, the shelf 44 may be about 8.5 feet from the tip 40 and, thus, the scales 66 may be configured to indicate a span or range of heights, for example, from 8.5 feet to 20 feet from the caisson tip 40. The scales 66 are at least three in quantity (only two shown in FIG. 11) and may be equidistantly spaced about the caisson internal circumference.

Figure 12:
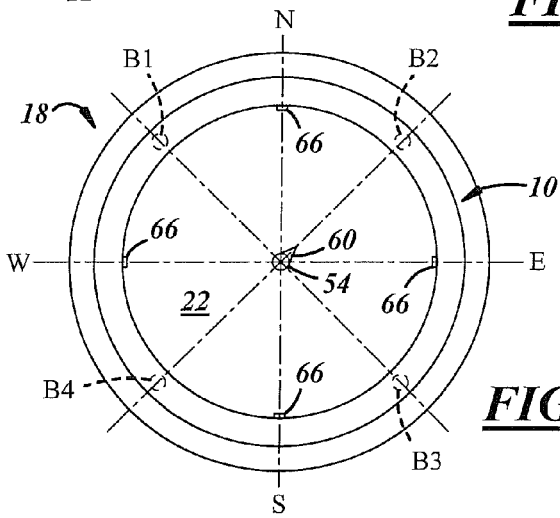
FIG. 12 is a schematic plan view of an example caisson in the starter pit of FIG. 2, and illustrating the pole, level, and scales shown in FIG. 11.

However, as shown in FIG. 12, four scales 66 equidistantly spaced circumferentially about the caisson 10 may correspond to the four compass points N, S, E, W. Also, because only three scales may be used to calculate caisson tilt, the fourth scale may act as a check on the other three. In FIG. 12, the quadrants NW, NE, SE, SW may also correspond to the soil profile bores B1, B2, B3, B4, such that each quadrant may span a corresponding one of the bores.

Any suitable type of scale may be used. In one embodiment, the scales 66 may include a ruled scale and a laser sensor coupled to the ruled scale to sense a laser beam from the level 60 and indicate a corresponding height on the ruled scale when the laser beam is projected onto the laser sensor. An example of a laser sensor includes a ROD-EYE brand laser detector available from Leica of Germany that may detect the rotating laser beam of the RUGBY brand laser level. In another embodiment, a barcoded scale may be used for scanning and reading by a digital level, for instance, the SPRINTER brand digital level from Leica. In a further embodiment, a simple ruled scale may be used for reading by a human, for instance, by an operator of an excavator. The operator may use binoculars or the like to observe the scale readings.

Referring again to FIG. 11, the level 60 is applied to the scales 66 to determine elevation of the caisson 10, for example, by way of its tip 40. For instance, because the scales 66 are placed in reference to the tip 40 of the caisson 10, the level 60 and scales 66 may be used to indicate heights from the level 60 to circumferential locations of the caisson tip 40 corresponding to the circumferential locations of the scales 66. And elevations of the circumferential locations of the tip 40 may be determined by subtracting the indicated heights from the established elevation of the level 60.

Figure 13C:
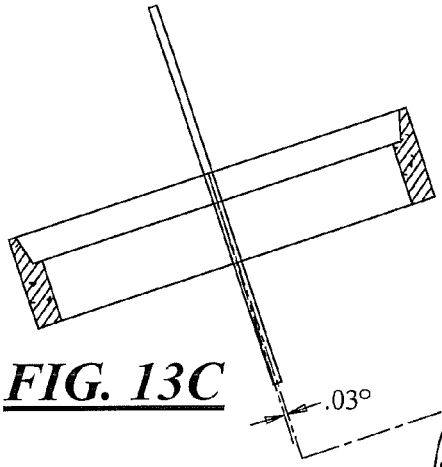
FIGS. 13A-C are example elevation, plan, and projection schematic representations of input and output data for a caisson tilt calculation.
Figure 13A:
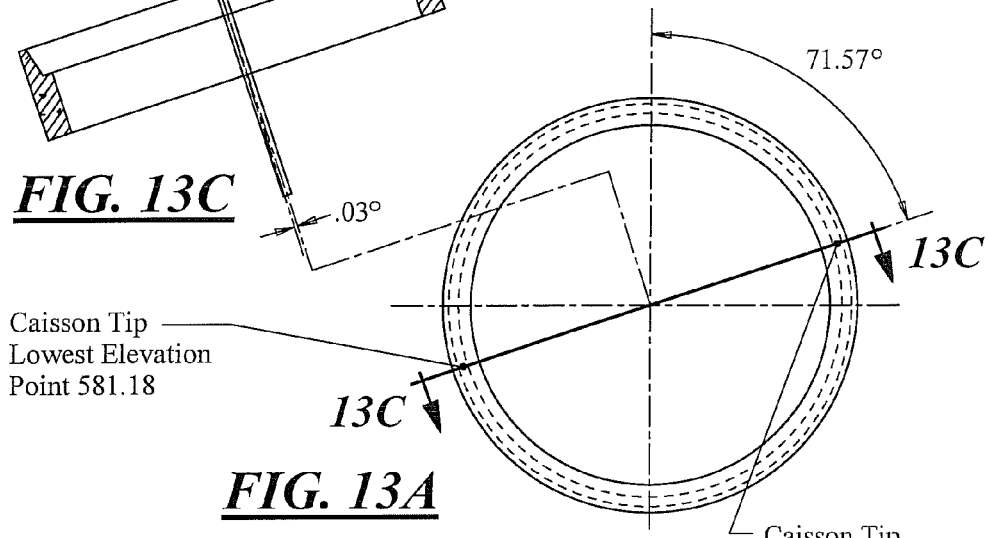
Figure 13B:
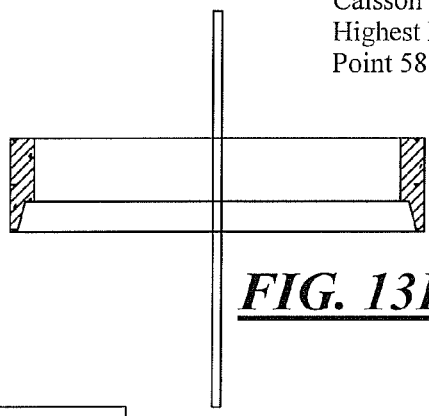

Referring now to FIGS. 13A-C, caisson tilt is calculated using differences among the determined tip elevations. For example, the level may be at an established elevation of 590.29 feet above sea level, and example scale readings are 9.07 feet for point N, 9.05 feet for point E, 9.04 feet for point S, and 9.11 feet for point W. The tilt may be calculated using any suitable technique, for example, using a computer aided design (CAD) software program, for instance, INVENTOR brand CAD software available from Autodesk, of San Rafael, Calif. Those of ordinary skill in the art will recognize that CAD software includes automatic functions for characterizing and calculating many aspects of cylinders, for example, tilt angles in North-South and East-West planes, compound tilt angles, and elevations of any given points on the cylinder. However, an exemplary "manual" input CAD method of calculating cylinder tilt is described below.

First, as shown in FIGS. 13A-C, a model of the caisson 10 may be generated including an axis and a location of the level. Second, any three of the tip elevation readings at N, E, S, W compass points may be established as points on the model. For example, the N, E, and W compass point height readings may be input. Third, assuming the readings are different, a plane that is tilted is established through those three points to constrain the points. Fourth, the tilted plane may be coupled to the caisson model and then the plane and the model are tilted about the location of the level until the plane is horizontal. Fifth, a horizontal plane may be intersected with the tip of the now tilted model to establish a caisson tip lowest point and, 180 degrees apart, a caisson tip highest point. The CAD software calculates the circumferential degrees of the high and low points and the elevations of same. Sixth, at the tip of the model, a vector or section is drawn through the axis as shown by section A-A. The section is projected and its angle with respect to vertical is the tilt angle.

Accordingly, the output of the calculation may include a tilt vector including a magnitude and a direction. As shown in the illustrative FIGS. 13A-C, the calculation yields a result of 0.03 degrees of tilt with a highest point of the tip being 581.24 feet above sea level at 71.57 degrees (clockwise) from North, and with a lowest point of the tip being 581.18 feet above sea level at 251.57 degrees from North.

Figure 14:
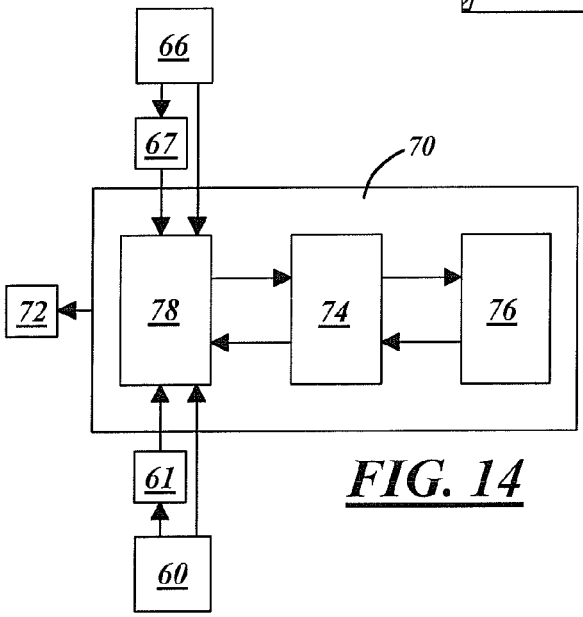
FIG. 14 is a block diagram of an example controller and related devices for calculating caisson tilt.

Any suitable apparatus may be used to perform the calculations, for example, a controller 70 as shown in FIG. 14. The controller 70 may be loaded with the aforementioned CAD software. In general, the controller 70 may receive and process input from a human operator, the level 60, and/or the scales 66, in light of stored instructions and/or data, and transmit output signals for example, to a display or other suitable output device 72 for use by, for example, a construction foreman in deciding how to adjust a sinking caisson installation. The controller 70 may include, for example, an electrical circuit, an electronic circuit or chip, and/or a computing device. In the computing device embodiment, the controller 70 generally may include a digital processor 74, memory 76 that may be coupled to the processor 74, and one or more interfaces 78 coupling the controller 70 to one or more other devices. Although not shown, the controller 70 and other powered system devices may be supplied with electricity by a power supply, for example, one or more batteries (not shown).

The processor 74 may execute instructions that provide at least some of the functionality for the sinking caisson controller 70. As used herein, the term instructions may include, for example, control logic, computer software and/or firmware, programmable instructions, or other suitable instructions. The processor 74 may include, for example, one or more microprocessors, microcontrollers, application specific integrated circuits, and/or any other suitable type of processing device.

Also, the memory 76 may be configured to provide storage for data received by or loaded to the sinking caisson controller 70, and/or for processor-executable instructions. The data and/or instructions may be stored, for example, as look-up tables, formulas, algorithms, maps, models, and/or any other suitable format. The memory may include, for example, RAM, ROM, EPROM, and/or any other suitable type of storage device.

Finally, the interfaces 78 may include, for example, analog/digital or digital/analog converters, signal conditioners, amplifiers, filters, other electronic devices or software modules, and/or any other suitable interfaces. The interfaces 78 may conform to, for example, RS-232, parallel, small computer system interface, universal serial bus, CAN, MOST, LIN, FlexRay, and/or any other suitable protocol(s). The interfaces 78 may include circuits, software, firmware, or any other device to assist or enable the controller 70 in communicating with other devices. In a wired embodiment, the interfaces 78 may include a network interface card (e.g. Ethernet card) for direct wired communications, for example, to the level 60 and/or scales 66.

In a wireless embodiment, the interfaces 78 may include any receiver that enables the controller 70 to communicate with other devices and/or systems, for example, the level 60 and/or readouts of the scales 66 if electronic. Similarly, the level 60 and/or scales 66 may be coupled to any suitable wireless transmitters 61, 67. Thus, the interfaces 78 may convert signals from the transmitters 61, 67 to suitable signals for use by the processor 74. Of course, the interfaces 78 and transmitters 61, 67 may include suitable antennas for transmission and reception of wireless signals. The interfaces 78 also may include a wireless network interface (e.g. WiFi) card for wireless communications. The interfaces 78 may also include, for example, a universal serial bus (USB) port for communications over a cable, a short-range communications device (e.g., a Bluetooth wireless interface or WiFi), a near-field communication (NFC) device, etc. The interfaces 78 may include a global satellite navigation and positioning system receiver for assisting in the determination of the elevation of the pole 54. Any suitable wireless protocol may be used, for example, WiMax, Bluetooth, and/or Wi-Fi.

At least portions of the disclosed method may be performed as a computer program and the various level elevations, scale readings, and/or tip elevation determinations may be stored in memory. The computer program may exist in a variety of forms both active and inactive. For example, the computer program can exist as software program(s) comprised of program instructions in source code, object code, executable code or other formats; firmware program(s); or hardware description language (HDL) files. Any of the above can be embodied on a computer usable medium, which may be stored on any suitable computer usable storage devices including conventional computer system RAM (random access memory), ROM (read only memory), EPROM (erasable, programmable ROM), EEPROM (electrically erasable, programmable ROM), and magnetic or optical disks or tapes. It is therefore to be understood that the method may be at least partially performed by any electronic device(s) capable of executing the above-described functions.

Referring again to FIG. 6, once the caisson shoe 12 and/or launch stages 14 are sufficiently solidified, the shoe forms 38 are disassembled and removed. Then, the launch pad timbers are removed to launch the caisson 10, which sinks into the earth E under its own massive weight. As the caisson 10 sinks, the level 60 and scales 66 can be used to calculate caisson tilt on a real-time or substantially continuous basis.

After the caisson 10 has sunk a sufficient amount, subsequent stages of the caisson 10 may be cast in place in the form 52 over top of the launch stage(s) 14, which recede further and further away from the form 52 as the caisson 10 sinks into the earth E. Typically, each succeeding stage is poured and cast one at a time on top of the immediately preceding stage. The additional weight of subsequent stages may be enough to cause the caisson 10 to start sinking again or to continue sinking but at a faster rate. Frequently, the caisson continues to sink while a stage of concrete is being poured and cast.

Figure 15:
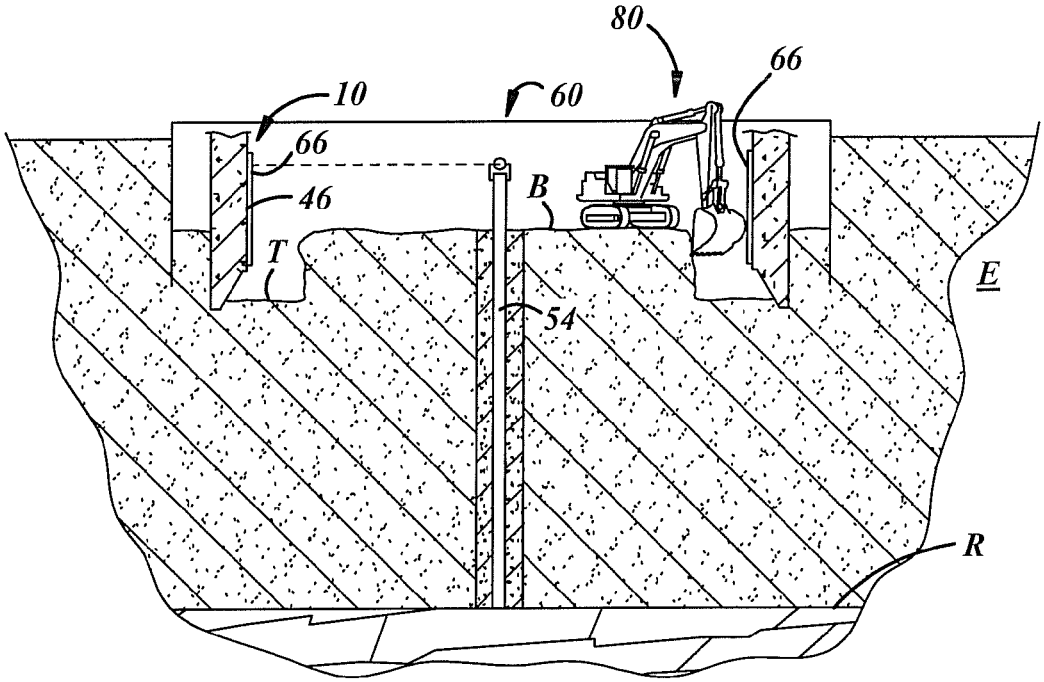
FIG. 15 is an elevational, cross-sectional view of the sinking caisson of FIG. 1 at some point after launch.

Also, as shown in FIG. 15, earth within the perimeter of the caisson 10 is excavated. More specifically, a trench T corresponding to the interior surface 46 of the caisson 10 is excavated. The trench T may be divided into segments or quadrants that correspond to the bores B1-B4 and/or the scales 66. Also, the trench defines a bench B upon which an excavator 80 may rest. In addition to excavating the trench T to reduce interior drag forces on the caisson 10, the bench B may also be excavated in a progressive controlled fashion to allow outward to inward earthen flow around the tip of the shoe and some concomitant floor heaving at the bench B to reduce exterior drag forces on the caisson 10.

Figure 16:
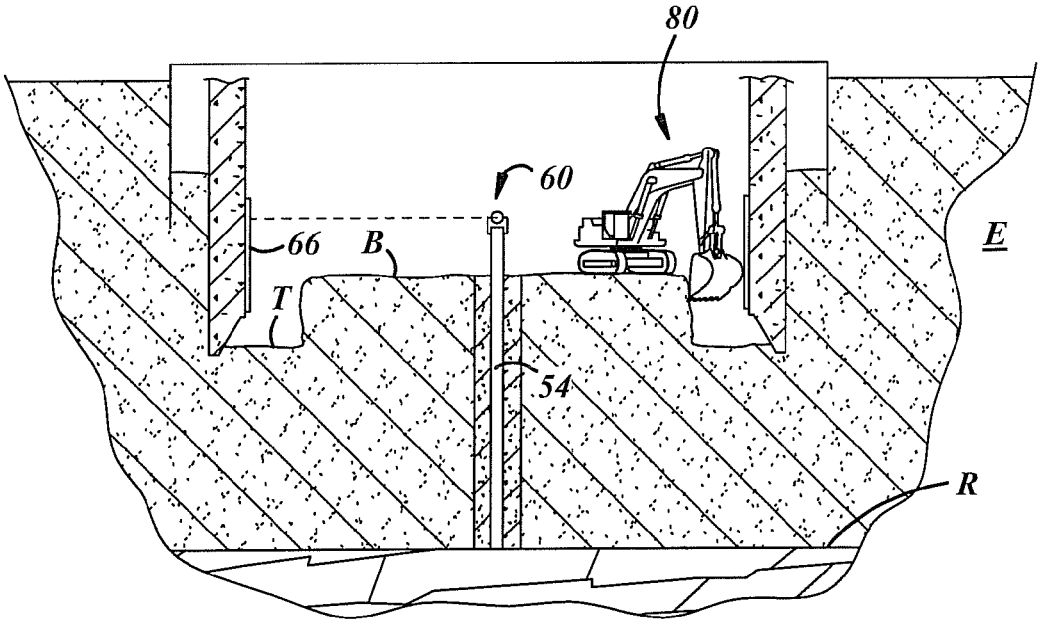
FIG. 16 is an elevational, cross-sectional view of the sinking caisson of FIG. 1 at another point after launch subsequent to that shown in FIG. 15.

Eventually, the sinking of the caisson 10 will pull the scales downward such that the level 60 becomes out of range of the scales 66. Thus, the level 60 may be relocated to a known lower elevation on the pole 54 to maintain the level 60 within range of the scales 66 in response to the sinking of the caisson 10. For example, as shown in FIG. 16, the level 60 may have been removed from the pole 54, and the pole 54 may have been cut at a desired one of the increments marked on the pole 54. Then, the level 66 may be replaced on the new, freshly cut top of the pole 54. Once relocated to the known lower elevation on the pole 54, the level 60 is again applied to the scales 66 to indicate tip heights and determine tip elevations with respect to the new known lower elevation of the level 60, and as described previously.

Figure 17:
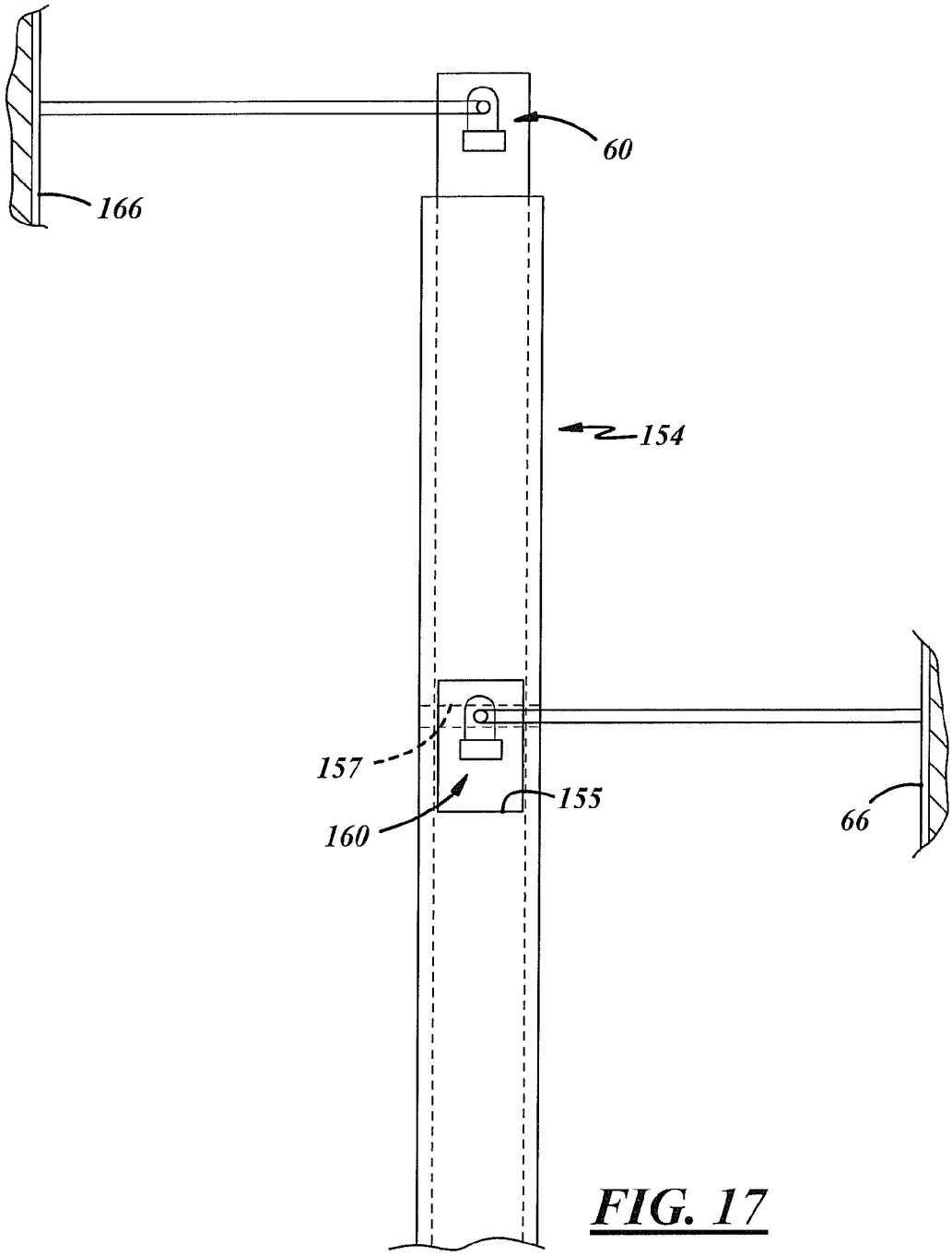
FIG. 17 is a fragmentary schematic view of a portion of another example pole carrying multiple levels.

In another embodiment, and referring to FIG. 17, a pole 154 may carry multiple levels 60, 160, and the caisson may be configured to carry multiple scales 66, 166. As the caisson is constructed and sunk, one or more scales 166 may be added in reference to the shoe scale 66 and/or the caisson tip. The pole 154 may be configured to carry any suitable number of levels, for example, as many as are desire to maintain a level within range of the scales 66 during sinking. In one example of this embodiment the level 60 may be carried atop the pole 154 as discussed previously, and the other level(s) 160 may be carried within the pole 154. In this case, the pole 154 may be larger in diameter than the previously discussed pole 54. For example, the pole 154 may be on the order of twelve inches in diameter or any suitable size to accommodate placement of the level 160. Also, the pole 154 may be provided with an access aperture 155 into which the level 160 may be inserted. Also, the pole 154 may be provided with, for example, four beam windows 157 corresponding in circumferential position to the scales 66. The beam windows 157 may be discrete circumferential interruptions in the pole 154. The aperture 155 and the windows 157 may be produced by cutting, torching, or in any suitable manner. Once placed in the aperture 155, the level 160 may be supported by brackets, bracing, epoxy, adhesive foam, or in any other suitable manner.

Accordingly, readings from the multiple levels 60, 160 and scales 66, 166 may be used to generate multiple caisson tilt vectors, and/or to generate a composite tilt vector. For example, those of ordinary skill in the art will understand that CAD software includes sophisticated solid modeling features capable of performing a best fit of multiple tilt vectors. In other example, the CAD software could calculate an average of multiple highest caisson tip points, an average of lowest caisson tip points, and an average of circumferential degrees of the highest and lowest points, and the like. Such averages could be used in a downstream composite tilt vector calculation.

Referring to FIGS. 18A-18E, an excavation plan may be adjusted in response to the calculated tilt exemplified by FIGS. 13A-C. For example, if the calculated tilt falls into a caution range, then construction may be continued and a geotechnical consultant may be consulted. In another example, if the calculated tilt falls into an emergency range, then construction may be halted and the consultant consulted. In either case, the consultant reviews the excavation plan in light of the calculated tilt of the caisson, and in light of the soil profile exemplified by FIGS. 4A-4E and develops a modified excavation plan in any suitable manner.

FIGS. 18A-18E illustrate a progression of six different caisson tip elevations starting at 580.0 feet above sea level in the upper left corner. The plan may be developed based on the expected soil compositions at any given elevation, for example, according to soil borings and the soil profile in FIGS. 4A-4E, the weight of the then formed portion of the caisson, draft forces on the surface area of the caisson engaged with the earth, etc.

According to the plan, after launching the caisson, the caisson will sink under its own weight from 580.0 feet to 578.0 feet above sea level. Therefore, for the first three diagrams, both the bench and the trench elevations are to remain constant at 580.0 feet above sea level. As shown by the fourth diagram in the lower left hand corner (the elevation 577.0 feet), two feet of earth are to be excavated from a Northwest quadrant of the trench and no earth is to be excavated from the other quadrants or the bench. According to the plan, this first excavation step will sink the caisson to an elevation of 577.0 feet above sea level. As shown by the fifth diagram (the elevation 576.0 feet), the Northwest quadrant is to be excavated one foot and the bench and the rest of the quadrants are to be excavated two feet. Accordingly, this second excavation step will sink the caisson to an elevation of 576 feet above sea level. As shown in the last diagram (tip elevation 575.0 feet), the Northwest quadrant is to be excavated two feet, and the bench and the Eastern quadrants are not to be excavated, but the Southwest quadrant is to be excavated three feet. Accordingly, this third excavation step will sink the caisson to an elevation of 575 feet above sea level.

A method of maintaining plumbness of a sinking caisson may be carried out using the calculated tilt from the monitoring method described above. For example, the calculated tilt may be used as an input parameter to adjust excavation of the caisson or as an input parameter to adjust pouring of concrete for the caisson.

While the forms of the invention herein disclosed constitute presently preferred embodiments, many others are possible. It is not intended herein to mention all the possible equivalent forms or ramifications of the invention. It is understood that the terms used herein are merely descriptive, rather than limiting, and that various changes may be made without departing from the spirit or scope of the invention.

What is claimed is:

1. A method of monitoring verticality of a sinking caisson having a tip, comprising:

placing a pole into the earth to a pole depth corresponding to a desired substantially final depth of the caisson tip;

coupling at least one level to the pole;

establishing an elevation of the at least one level;

carrying scales on an interior surface of the caisson in spaced circumferential locations and in reference to the caisson tip;

applying the at least one level to the scales to indicate heights from the caisson tip corresponding to the circumferential locations of the scales;

determining tip elevations corresponding to the circumferential locations of the scales by subtracting the indicated heights from the established elevation of the at least one level; and calculating any tilt of the caisson from any differences among the determined tip elevations.

2. The method of claim 1 wherein the pole is inserted into the earth to a layer of bedrock.

3. The method of claim 1 wherein a rotating laser level is fixed to the top of the pole.

4. The method of claim 1 wherein the elevation of the at least one level is established in reference to an elevation of the top of the pole which is determined in reference to a benchmark.

5. The method of claim 1 wherein at least three scales are carried by the caisson.

6. The method of claim 5 wherein four scales are carried by the caisson in equally circumferentially spaced-apart locations on the caisson.

7. The method of claim 1 wherein the tilt is calculated using a computer aided design program.

8. The method of claim 1 further comprising:

relocating the at least one level on the pole at a known lower elevation to maintain the at least one level within range of the scales in response to sinking of the caisson;

again applying the at least one level to the scales to indicate heights from the at least one level to the tip corresponding to the locations of the scales;

determining tip elevations corresponding to the locations of the scales by subtracting the indicated heights from the known lower elevation of the at least one level; and again calculating any tilt of the caisson from any differences among the indicated elevations.

9. A method of maintaining plumbness of a sinking caisson by using the calculated tilt of claim 1 as an input parameter to adjust excavation of the caisson.

10. A method of maintaining plumbness of a sinking caisson by using the calculated tilt of claim 1 as an input parameter to adjust pouring of concrete for the caisson.

11. A sinking caisson installation, comprising:

a sinking caisson having a tip;

a pole inserted into the earth to a pole depth corresponding substantially to a desired final depth of the caisson tip;

at least one level coupled to the pole at an established elevation; and scales carried on an interior surface of the sinking caisson in spaced circumferential locations and in reference to the caisson tip, wherein the at least one level is applied to the scales to indicate heights from the caisson tip corresponding to the circumferential locations of the scales, tip elevations are determined corresponding to the circumferential locations of the scales by subtracting the indicated heights from the established elevation of the at least one level, and tilt of the caisson is calculated from any differences among the determined tip elevations.

12. The sinking caisson installation of claim 11, wherein one of the levels is carried atop the pole, and the pole includes an access aperture to accommodate another one of the levels and also includes multiple windows for transmission of a beam.

* * * * *